US006746376B2

(12) United States Patent
Chang

(10) Patent No.: US 6,746,376 B2
(45) Date of Patent: Jun. 8, 2004

(54) FOLDING STRUCTURE FOR TREADMILL

(76) Inventor: Dick Chang, No. 42, Lane 12, Shen Lin Rd., Shen-Kang Hsiang, Tai-Chung Hsien (TW)

( * ) Notice: Subject to any disclaimer, the term of this patent is extended or adjusted under 35 U.S.C. 154(b) by 0 days.

(21) Appl. No.: 10/316,925

(22) Filed: Dec. 12, 2002

(65) Prior Publication Data

US 2004/0023758 A1 Feb. 5, 2004

(30) Foreign Application Priority Data

Aug. 1, 2002 (TW) ..... 91211973 U

(51) Int. Cl.[7] ..... A63B 22/02
(52) U.S. Cl. ..... 482/54; 482/904
(58) Field of Search ..... 482/51, 54, 904, 482/148, 57–65

(56) References Cited

U.S. PATENT DOCUMENTS 5,868,648 A * 2/1999 Coody et al. ..... 482/54
6,050,923 A * 4/2000 Yu ..... 482/54
6,419,612 B1 * 7/2002 Yu ..... 482/54
6,638,200 B2 * 10/2003 Chang ..... 482/54

* cited by examiner

*Primary Examiner*—Stephen R. Crow
(74) *Attorney, Agent, or Firm*—Rosenberg, Klein & Lee

(57) ABSTRACT

A foldable treadmill includes a base having two hollow side rails a slot is defined in an inner side of each of the two side rails and communicates with an interior of each side rail. A frame has two sides which are pivotably connected between two arms on the base by two links. An assistant frame is located between the two side rails of the base and has a first transverse bar and two support links are connected to the first transverse bar and pivotably connected to the underside of the frame. Two sub-wheels are connected to two extensions on two ends of the first transverse bar and movably received in the interior of the two side rails via the slots. The sub-wheels come out from the two openings when the frame is upright folded.

3 Claims, 9 Drawing Sheets

FOLDING STRUCTURE FOR TREADMILL

FIELD OF THE INVENTION

The present invention relates to a folding structure for a treadmill and which includes two sub-wheels movably received in the side rails of the base of the treadmill and the sub-wheels come out from two openings of the side rails to contact the floor when the treadmill is folded.

BACKGROUND OF THE INVENTION

A conventional treadmill is shown in FIGS. 8A and 8B and generally includes a base 72 which is pivotably connected to the frame 70 on which the belt of the treadmill is installed. A lifting mechanism 73 is connected to the base 72 and includes links 731 which has one end connected to a motor and worm system and the other end of the links 731 has a wheel 732 connected thereto which contacts the floor. Two sub-wheels 721 are located at an end of the base 72 so that when the frame 70 is located at a horizontal position as shown in FIG. 8A, the wheels 732, the sub-wheels 721 and the two legs 711 on the frame 70 contact the floor to support the frame 70. When the frame 70 is lifted at an angle relative to the floor frame 70, the sub-wheels 721 are lifted as shown in FIG. 8B. As shown in FIG. 7, when the frame 70 is folded to an upright position, only the wheels 732 contact the floor so that the whole treadmill moves on the floor and it is inconvenient to fold in up.

The present invention intends to provide a folding structure that includes two sub-wheels movably received in the side rails of the base and the two sub-wheels come out from two openings in the side rails so as to contact the floor to support the balance of the folded treadmill.

SUMMARY OF THE INVENTION

In accordance with one aspect of the present invention, there is provided a foldable treadmill which comprises a base having two hollow side rails and two openings are defined through an underside of the two side rails respectively. A slot is defined in an inner side of each of the two side rails and communicates with an interior of each side rail. Two arms of a handle are connected to the two side rails. A frame has two sides and two links are pivotably connected between the two arms of the handle and the two sides of the frame. An assistant frame is located between the two side rails of the base and has a first transverse bar. Two support links are connected to the first transverse bar and the underside of the frame. Two sub-wheels are connected to the two ends of the first transverse bar and movably received in the interior of the two side rails via the slots. The sub-wheels come out from the two openings when the frame is upright folded.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
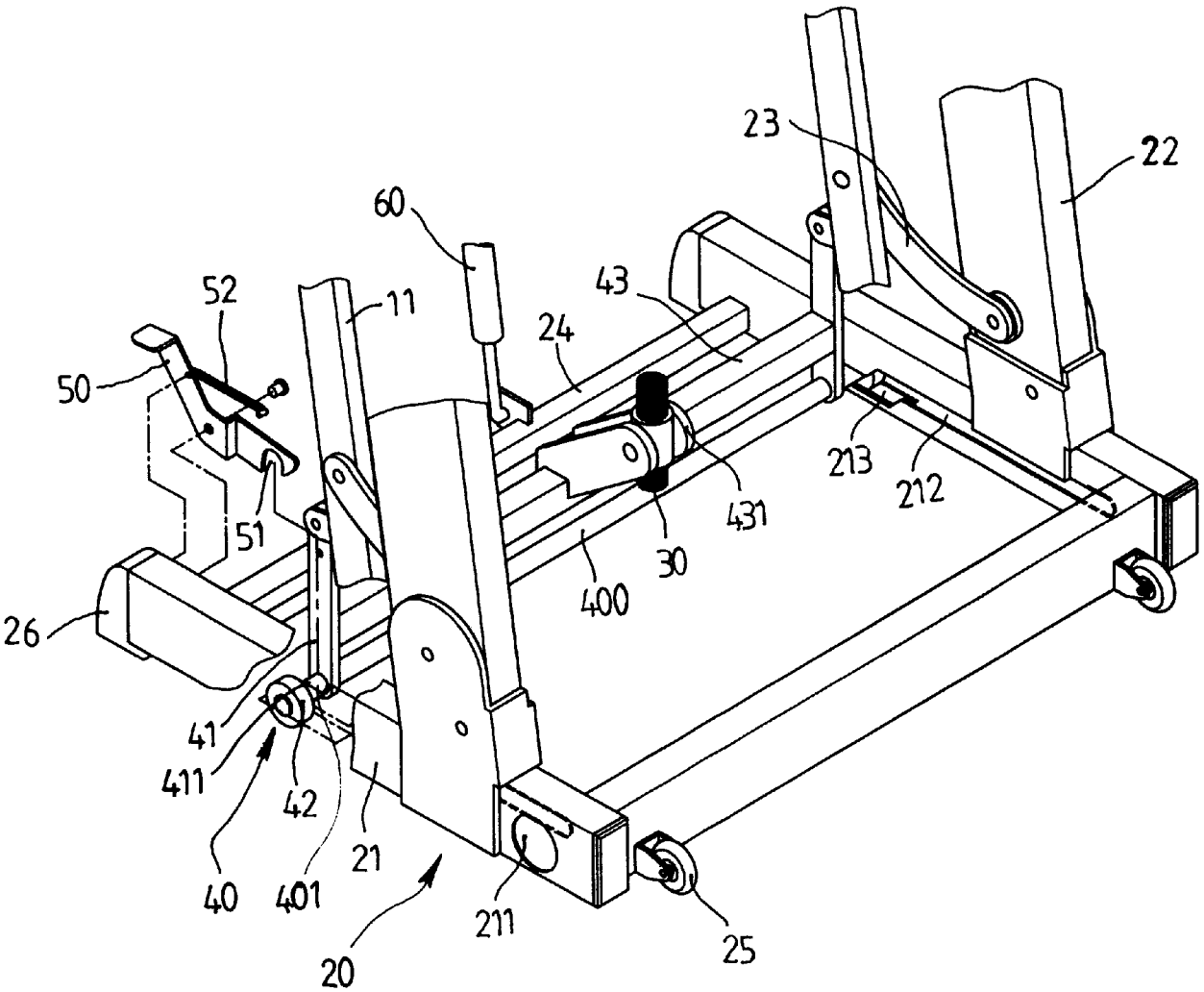
FIG. 1 shows the base and the assistant frame for the foldable treadmill of the present invention.
Figure 2:
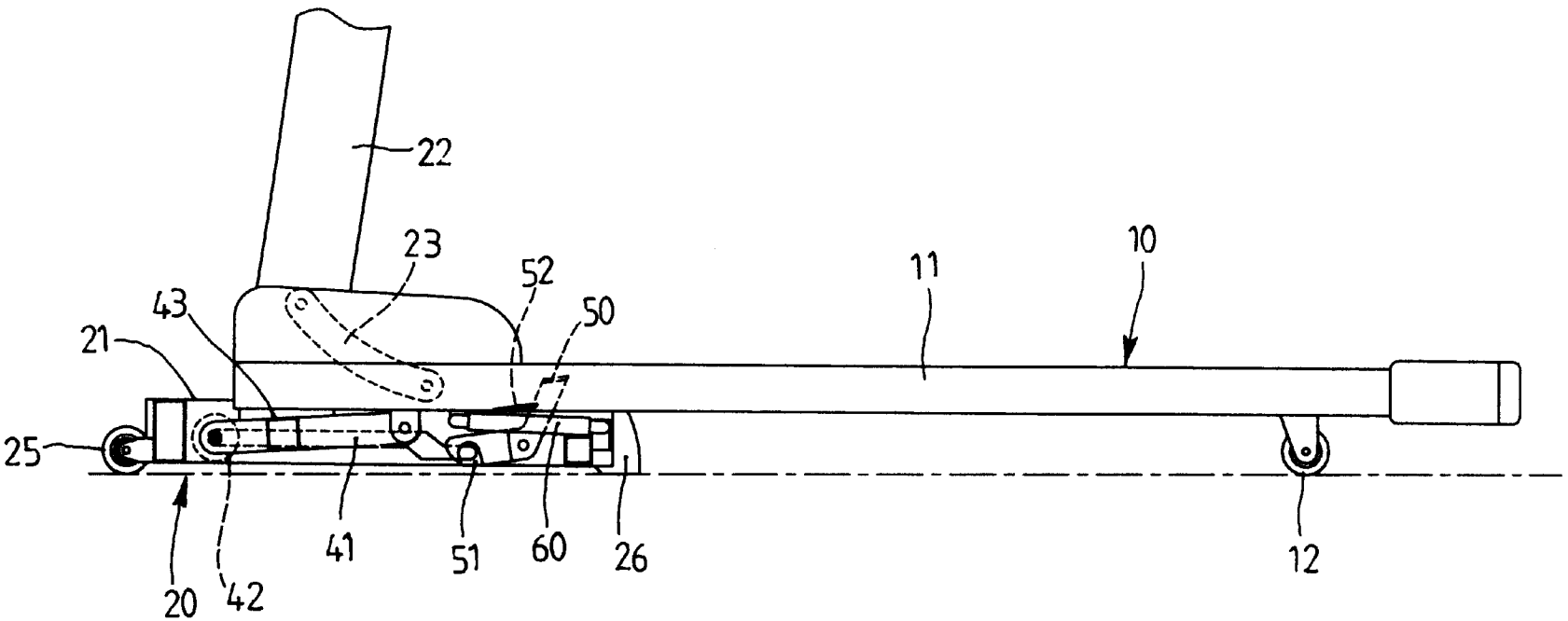
FIG. 2 shows a side view of the treadmill when the frame is in horizontal position.
Figure 3:
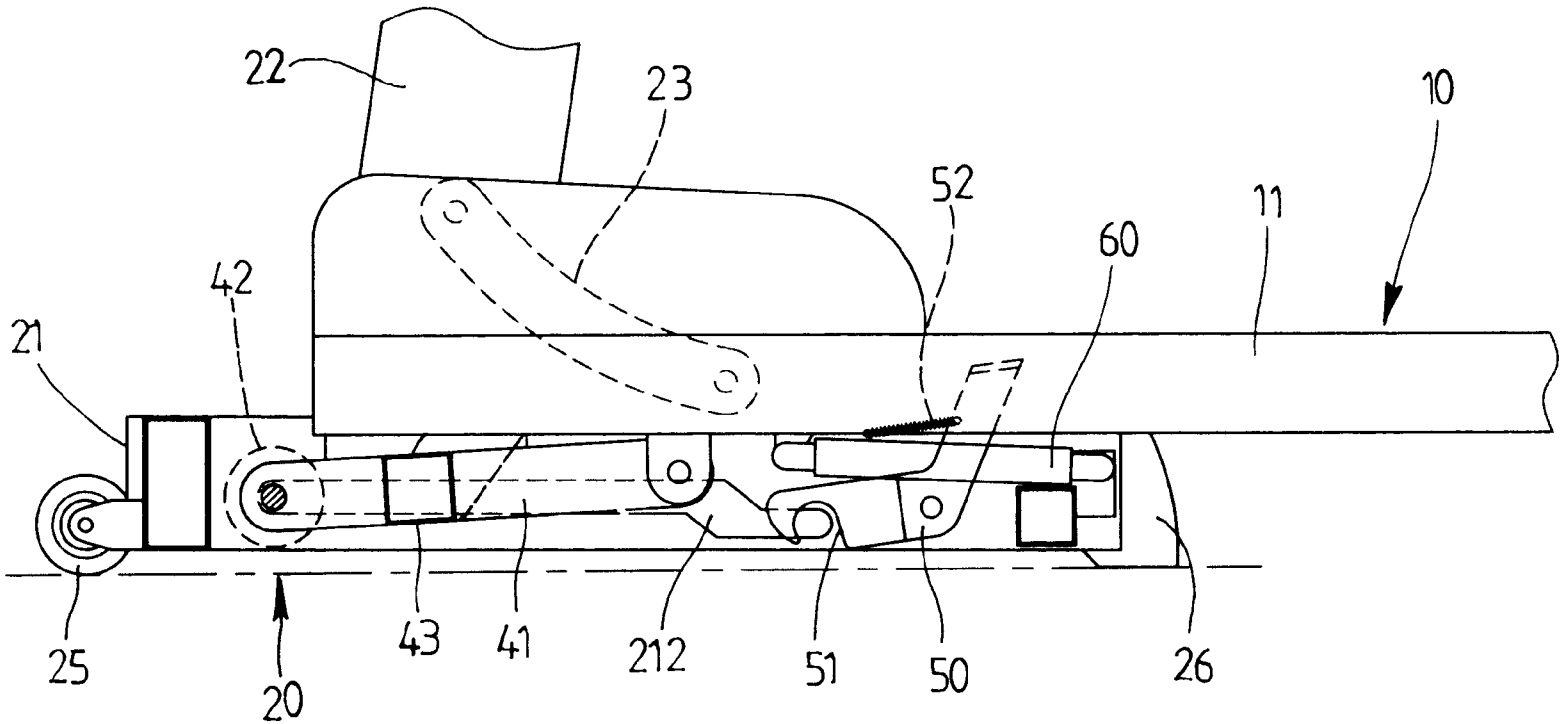
FIG. 3 shows the sub-wheels are received in the side rails of the base when the frame is in horizontal position.
Figure 4:
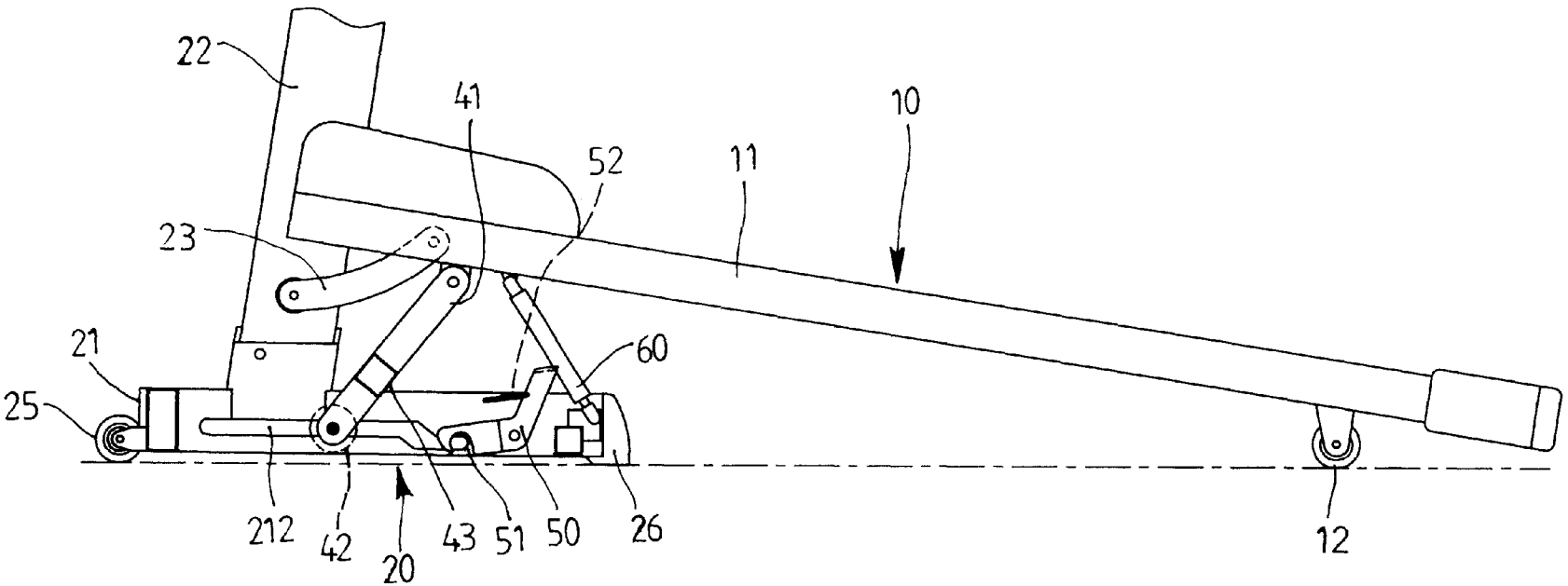
FIG. 4 shows the frame is lifted at an angle.

Referring to FIGS. 1 to 4, the foldable treadmill of the present invention comprises a base 20 having two hollow side rails 21 and two openings 213 are defined through an underside of the two side rails 21 respectively. A slot 212 is defined in an inner side of each of the two side rails 21 and communicates with an interior of each side rail 21. Two arms 22 of a handle are connected to the two side rails 21. Two wheels 25 are connected to an end of the base 20 and two pads 26 are connected to the other end of the base 20.

A frame 10 has two sides 11 and a running belt (not shown) is located between the two sides 11. Two curved links 23 are pivotably connected between the two arms 22 of the handle and the two sides 11 of the frame 10. At least one wheel 12 is connected to an underside of the frame 10 and located at a remote end of the frame 10 from the base 20.

An assistant frame 40 is located between the two side rails 21 of the base 20 and has a first transverse bar 400. Two support links 41 are connected to the first transverse bar 400 and pivotably connected to the underside of the frame 10. Two extensions 401 extend from two ends of the first transverse bar 400 respectively and two sub-wheels 42 are connected to the two extensions 401. The two extensions 401 are inserted in the interior of the two side rails 21 via the slot 212 and the two sub-wheels 42 are movably received in the interior of the two side rails 21. A second transverse bar 24 is connected between the two side rails 21 and a cylinder 60 is connected to the second transverse bar 24. An extension rod 60 of the cylinder 60 is pivotably connected to the frame 10 so that when the frame 10 is pivoted upward, the extension rod 60 extends and support the frame 10. Another transverse bar 43 is connected between the two support links 41 and two lugs 431 are extended from the transverse bar 43. A worm rod 30 driven by a motor (not shown) is connected to a collar connected to the two lugs 431 so as to lift the frame 10 to adjust the angle relative to the floor of the frame 10.

A hook 50 is pivotably connected to the inner side of one of the two side rails 21 and includes a hooking end 51 and an operation end. A spring 52 has one end connected to the operation end and the other end of the spring 52 is connected to the side rail 21 that the hook 50 is connected to.

Figure 5:
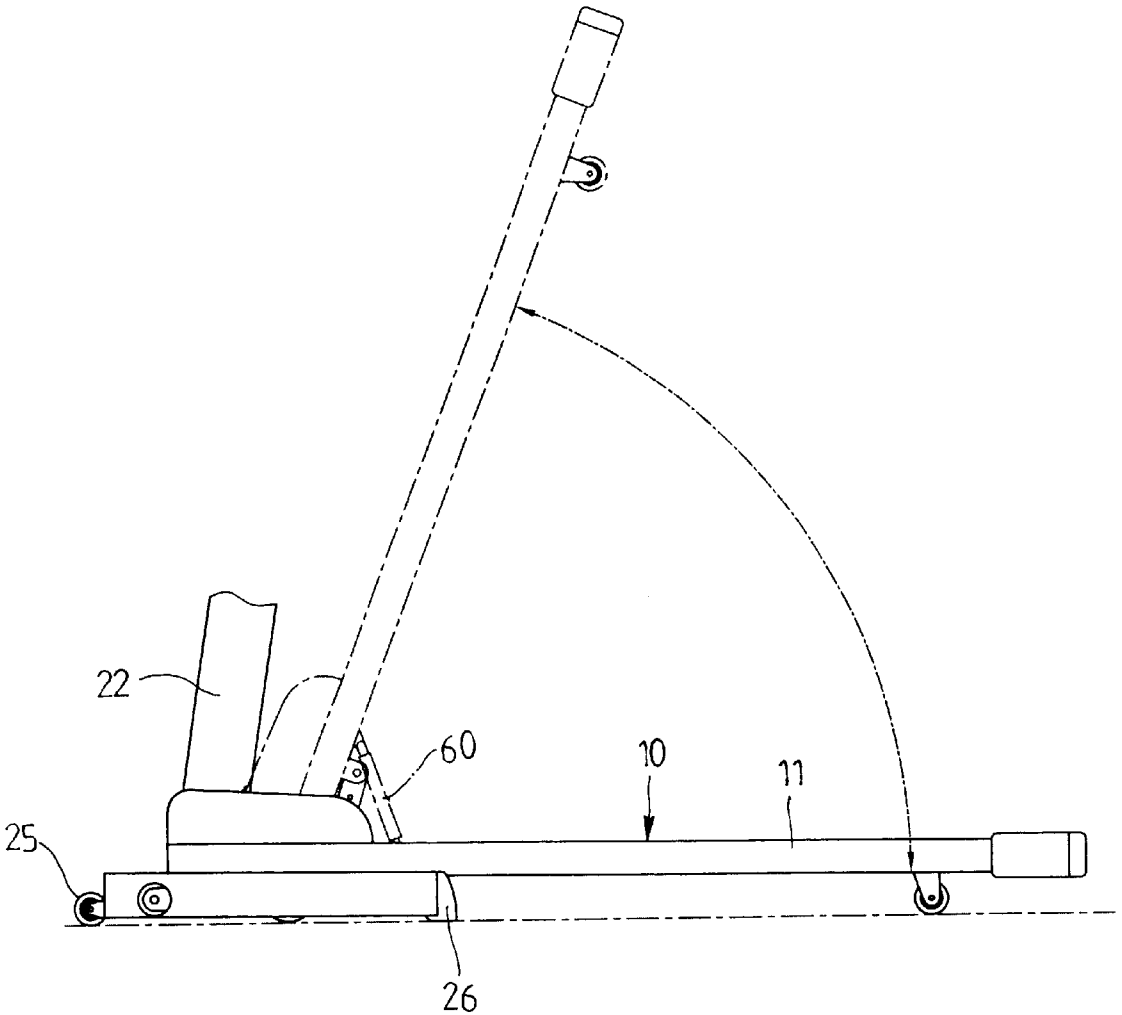
FIG. 5 shows a cylinder supports the frame which is folded upward.
Figure 6A:
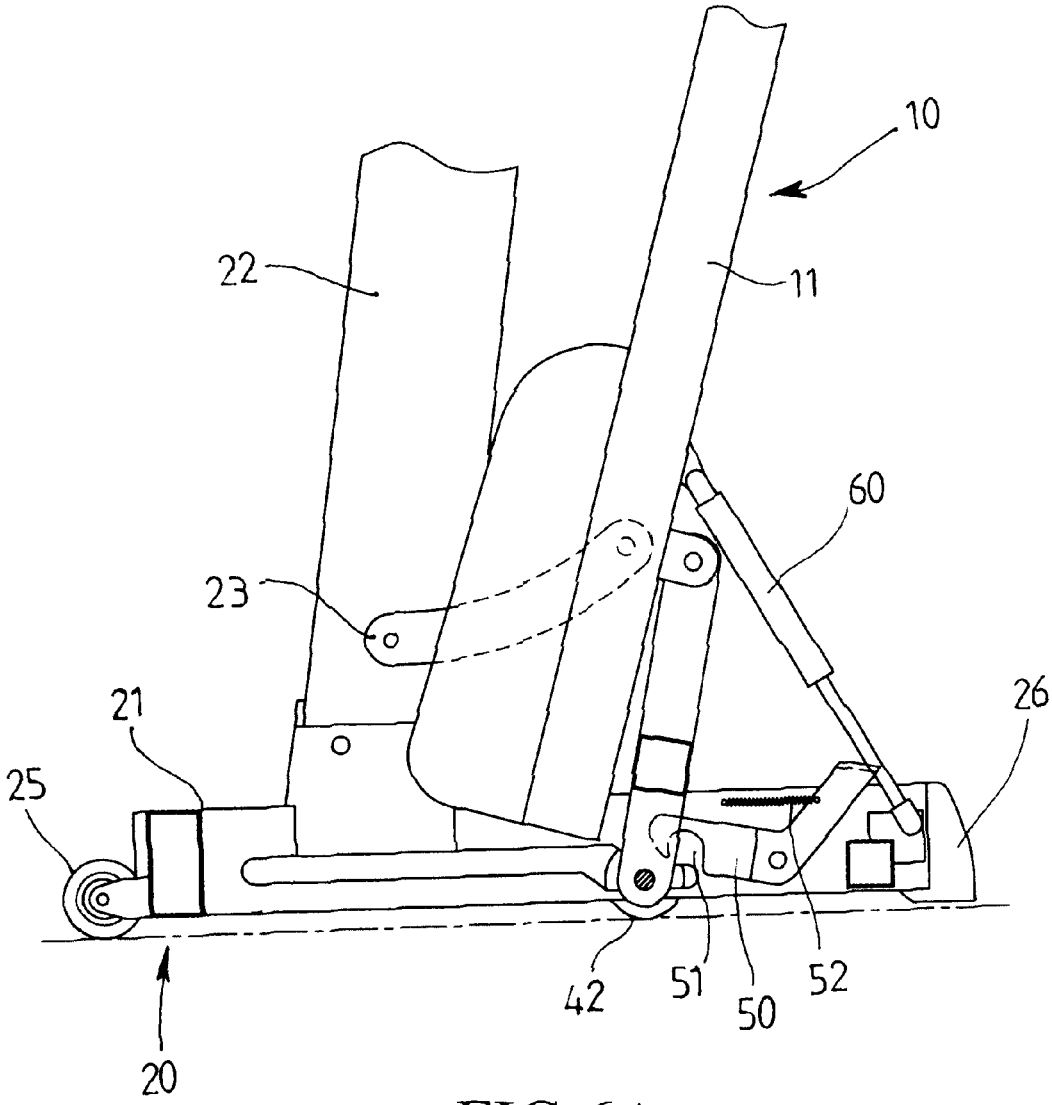
FIGS. 6A and 6B shows the hook hooks on the extension when the frame is folded upright.
Figure 6B:
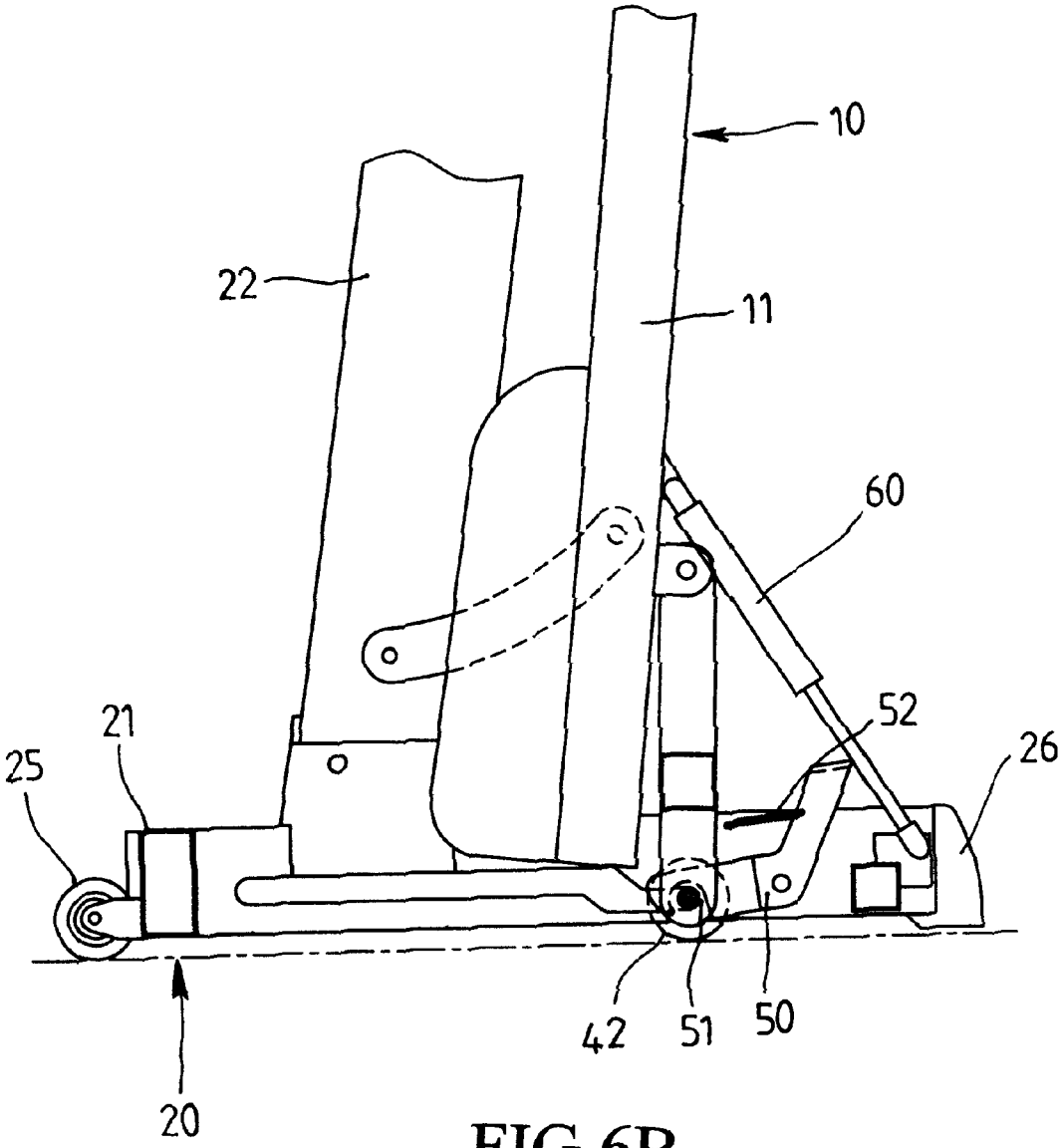
Figure 7:
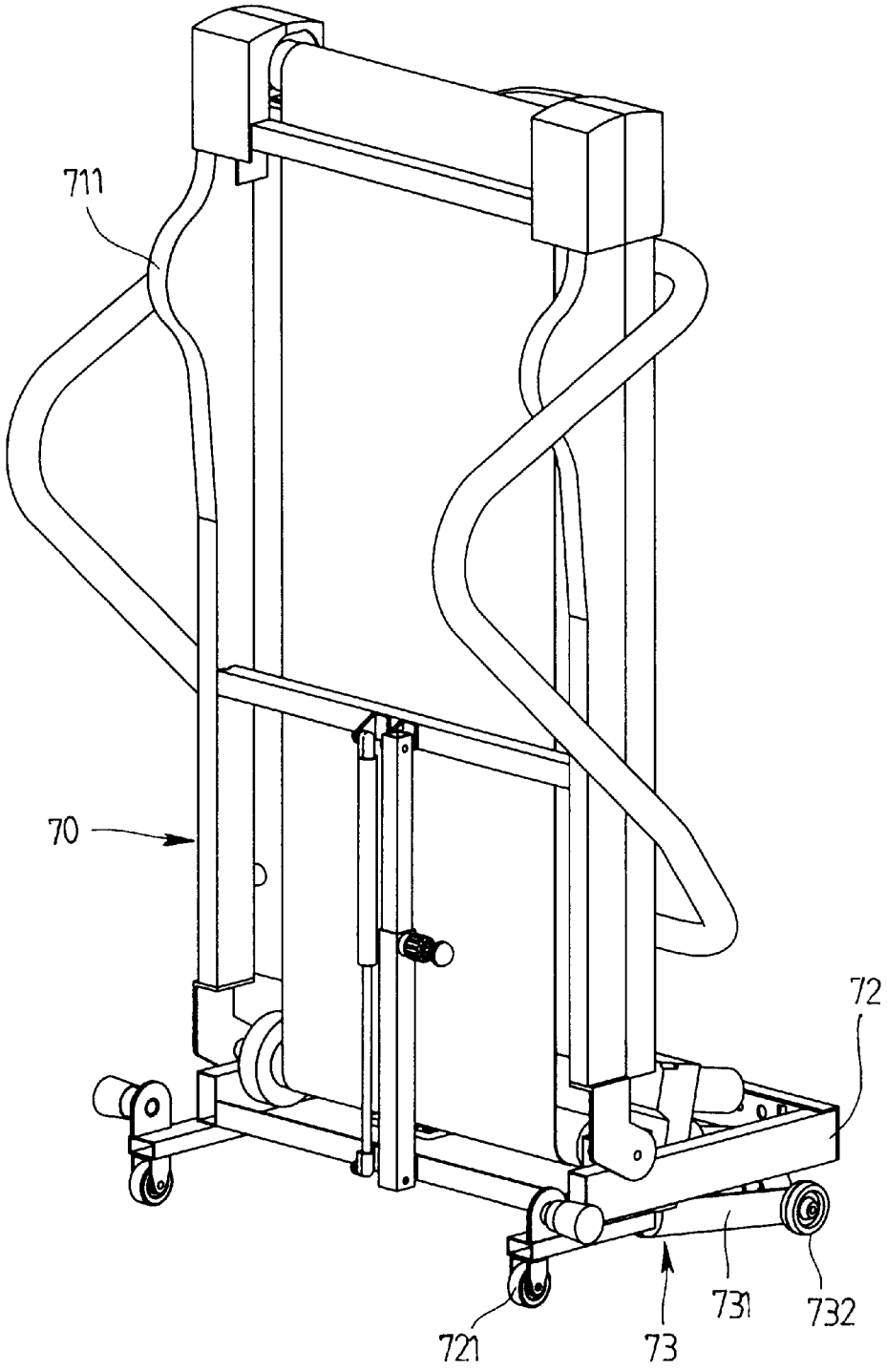
FIG.7 PRIOR ART
FIG. 7 shows a conventional treadmill which is folded at its upright position.
Figure 8A:
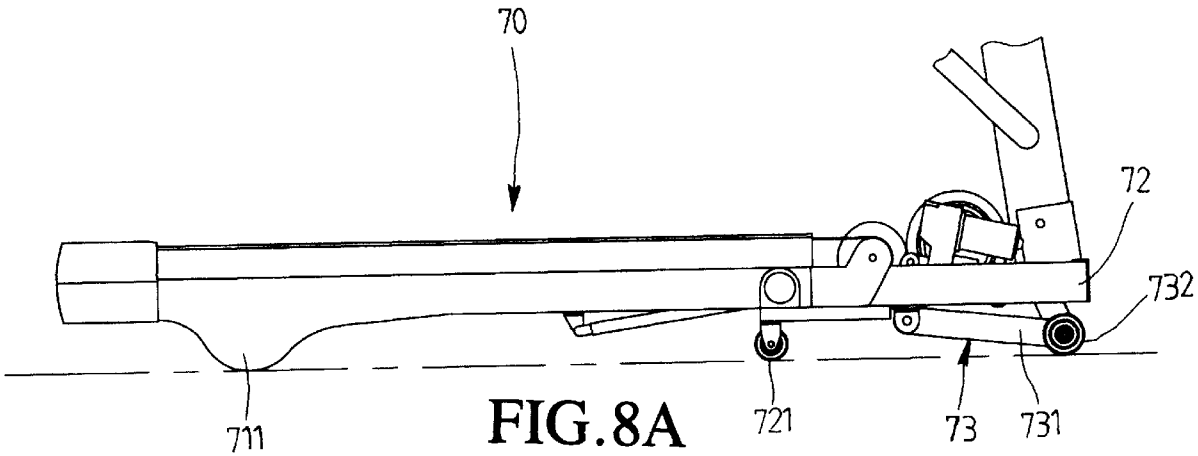
FIG. 8A PRIOR ART
FIG. 8A shows that the conventional treadmill is in its ready-for-use position.
Figure 8B:
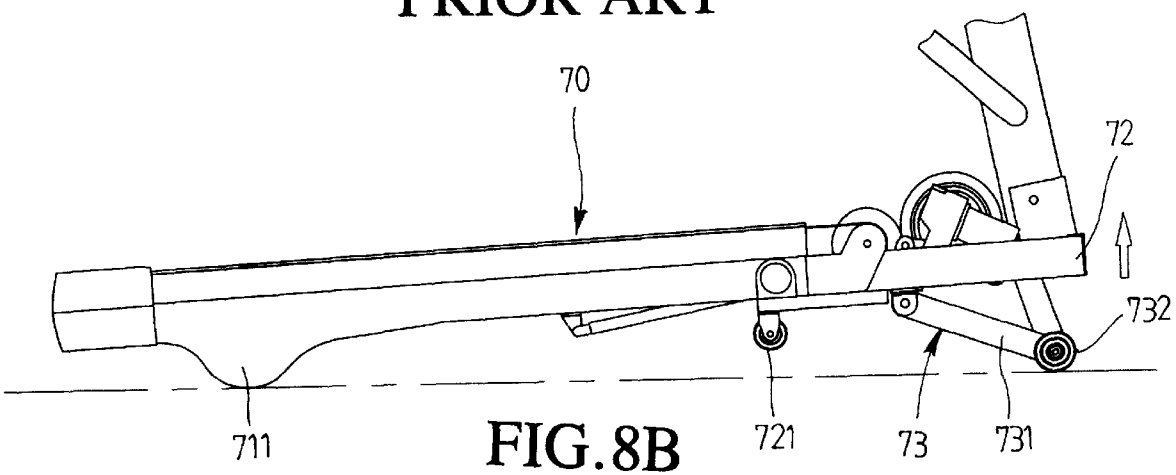
FIG. 8B PRIOR ART
FIG. 8B shows that the frame of the conventional treadmill is lifted.

Referring to FIG. 5, when the frame 10 is folded upward, the cylinder 60 helps the user to support the weight of the frame 10 and the two sub-wheels 42 are moved toward the openings 213 along the pivotal movement of the frame 10. As shown in FIGS. 6A and 6B, when the frame 10 is positioned at its upright position, the sub-wheels 42 come out from the openings 213 and contact the floor so that the base 20 can be kept in balance by the wheels 25 and the sub-wheels 42. The hook 50 can hook on. the extension 401 to hold the transverse bar 400 when the frame 10 is in an upright position. The hook 50 is disengaged from the extension 401 by stepping downward the operation end.

While we have shown and described the embodiment in accordance with the present invention, it should be clear to those skilled in the art that further embodiments may be made without departing from the scope of the present invention.

What is claimed is:

1. A foldable treadmill comprising:

a base having two hollow side rails and two openings defined through an underside of the two side rails respectively, a slot defined in an inner side of each of the two side rails and communicating with an interior of each side rail, two arms of a handle connected to the two side rails;

a frame having two sides and two links pivotably connected between the two arms of the handle and the two sides of the frame, at least one wheel connected to an underside of the frame and located at a remote end of the frame from the base, and an assistant frame located between the two side rails of the base and having a first transverse bar and two support links connected to the first transverse bar, the two support links pivotably connected to the underside of the frame and two extensions extending from two ends of the first transverse bar respectively, two sub-wheels connected to the two extensions and movably received in the interior of the two side rails via the slots, the sub-wheels coming out from the two openings when the frame is upright folded.

2. The foldable treadmill as claimed in claim 1, wherein a hook is pivotably connected to the inner side of one of the two side rails and including a hooking end and an operation end, a spring having one end connected to the operation end and the other end of the spring connected to the side rail that the hook is connected, the hooking end hooked to one of the extensions when the frame is folded upright.

3. The foldable treadmill as claimed in claim 1 further comprising a second transverse bar connected between the two side rails and a cylinder is connected to the second transverse bar, an extension rod of the cylinder pivotably connected to the frame.

* * * * *